US007874193B2

(12) United States Patent
Norin

(10) Patent No.: US 7,874,193 B2
(45) Date of Patent: Jan. 25, 2011

(54) CRIMPING DIE AND CRIMPING TOOL

(75) Inventor: Mats Norin, Älvdalen (SE)

(73) Assignee: Pressmaster AB, Alvdalen (SE)

( * ) Notice: Subject to any disclaimer, the term of this patent is extended or adjusted under 35 U.S.C. 154(b) by 859 days.

(21) Appl. No.: 11/703,163

(22) Filed: Feb. 7, 2007

(65) Prior Publication Data

US 2007/0199364 A1 Aug. 30, 2007

(30) Foreign Application Priority Data

Feb. 21, 2006 (SE) ..... 0600377

(51) Int. Cl.
*B25B 7/12* (2006.01)

(52) U.S. Cl. ..... 72/409.08; 72/409.01; 72/409.1; 72/402; 72/450

(58) Field of Classification Search . 72/409.01–409.19, 72/412–416, 450, 451, 402; 29/753
See application file for complete search history.

(56) References Cited

U.S. PATENT DOCUMENTS

| | | | | |
|---|---|---|---|---|
| 1,327,892 | A * | 1/1920 | Viertels | 72/409.19 |
| 3,094,702 | A * | 6/1963 | Haucke et al. | 72/402 |
| 3,177,695 | A * | 4/1965 | Van Oort | 72/402 |
| 3,459,029 | A * | 8/1969 | Rosenfeld et al. | 72/402 |
| 3,713,322 | A * | 1/1973 | Fischer | 72/409.09 |
| 4,612,794 | A * | 9/1986 | Schmidt | 72/409.06 |
| 6,176,116 | B1 | 1/2001 | Wilhelm et al. | |
| 7,461,448 | B2 * | 12/2008 | Schwartzman et al. | 29/753 |

FOREIGN PATENT DOCUMENTS

| | | |
|---|---|---|
| DE | 198 58 719 | 6/2000 |
| DE | 101 40 270 | 3/2003 |

OTHER PUBLICATIONS

Edgren, et al., "Grip Force Vectors for Varying Handle Diameters and Hand Sizes", Human Factors, vol. 46, No. 2, pp. 244-251, Summer 2004.

* cited by examiner

*Primary Examiner*—Edward Tolan
(74) *Attorney, Agent, or Firm*—Dickstein Shapiro LLP

(57) ABSTRACT

The invention relates to a crimping die (12,14,16,18) and a crimping tool (2) comprising at least three crimping dies (12,14,16,18) that are guided for displacement in the crimping tool (2), where each of the crimping dies (12,14,16,18) have a respective crimping surface (42,44,46,48) and a respective sliding surface (50,52,54,56), where the crimping surfaces (42,44,46,48) together form a crimping opening (36), said crimping surface (42,44,46,48) of each crimping die (12,14,16,18) slidably abutting said sliding surface (50, 52,54,56), of an adjacent die, where the crimping dies (12, 14,16,18) have pivot points (29,31,33,35) that are arranged movable relative to the body of the crimping tool (2) and where a linkage (11) is arranged to guide the movement of the pivot points (29,31,33,35) of the crimping dies (12,14,16,18) relative to the body (4) of the crimping tool (2) producing a movement between the pivot points (29,31,33,35) of the crimping dies (12,14,16,18) and the body (4) of the crimping tool (2), and where the crimping dies (12,14,16,18) have tooth flanks (66,68) arranged to cooperate with tooth flanks (60,62) in the body (4) of the crimping tool (2), whereby the crimping surfaces (42,44,46,48) of the crimping dies (12,14,16,18) are arranged to act on the workpiece (19) to be crimped without the crimping dies (12,14,16,18) sliding on the surface of the body (4) of the tool (2) thereby decreasing the wear between the crimping dies (12,14,16,18) and the body (4) of the tool (2.

11 Claims, 9 Drawing Sheets

CRIMPING DIE AND CRIMPING TOOL

FIELD OF THE INVENTION

The present invention relates to a crimping die and to a crimping tool comprising crimping dies.

BACKGROUND OF THE INVENTION AND RELATED ART

Cable termination tooling may comprise e.g. cutting tools, stripping tools and crimping tools. Some tools only have one of the above functions, whereas other tools have two or three of the above functions. Tools for cable termination may be hand tools or powered tools, e.g. hydraulically powered tools. Cable termination is required e.g. for connecting a cable or a wire to power, coaxial, fiber-optic or modular connectors.

When crimping, a connector i.e. a terminal, splice, contact or a similar device is mechanically secured to a cable—e.g to a conductor such as a wire—by deformation so that a solid joint having reliable mechanical and electrical connection is formed. The crimping operation resulting in a crimped joint is e.g. performed using crimping dies.

DE 198 58 719 A1 shows a crimping tool having an two-part-frame for adjusting the position of the crimping dies which crimping dies are pivotally mounted and axially fixed to the body of the crimping tool, i.e. the pivot points for the crimping dies are fixed relative to the body of the tool. Thus, a sliding movement occurs on the contact surface between the crimping dies and the workpiece to be crimped during the crimping operation.

SUMMARY OF THE INVENTION

The primary object of the present invention is to provide an improved crimping die in an improved crimping tool for guiding the movement of the crimping dies relative to the body of the tool. The crimping surfaces of the crimping dies are made to act on the workpiece to be crimped without sliding on the surface of the body of the tool thereby decreasing the wear between the crimping dies and the body of the tool.

The above mentioned object is achieved for a device having the features stated in claim 1.

These and other advantageous features will be apparent from the detailed description below.

The invention will now be described in more detail below with reference to the appended drawings which illustrate preferred embodiments of the device according to the invention.

DESCRIPTION OF PREFERRED EMBODIMENTS

Figure 1:
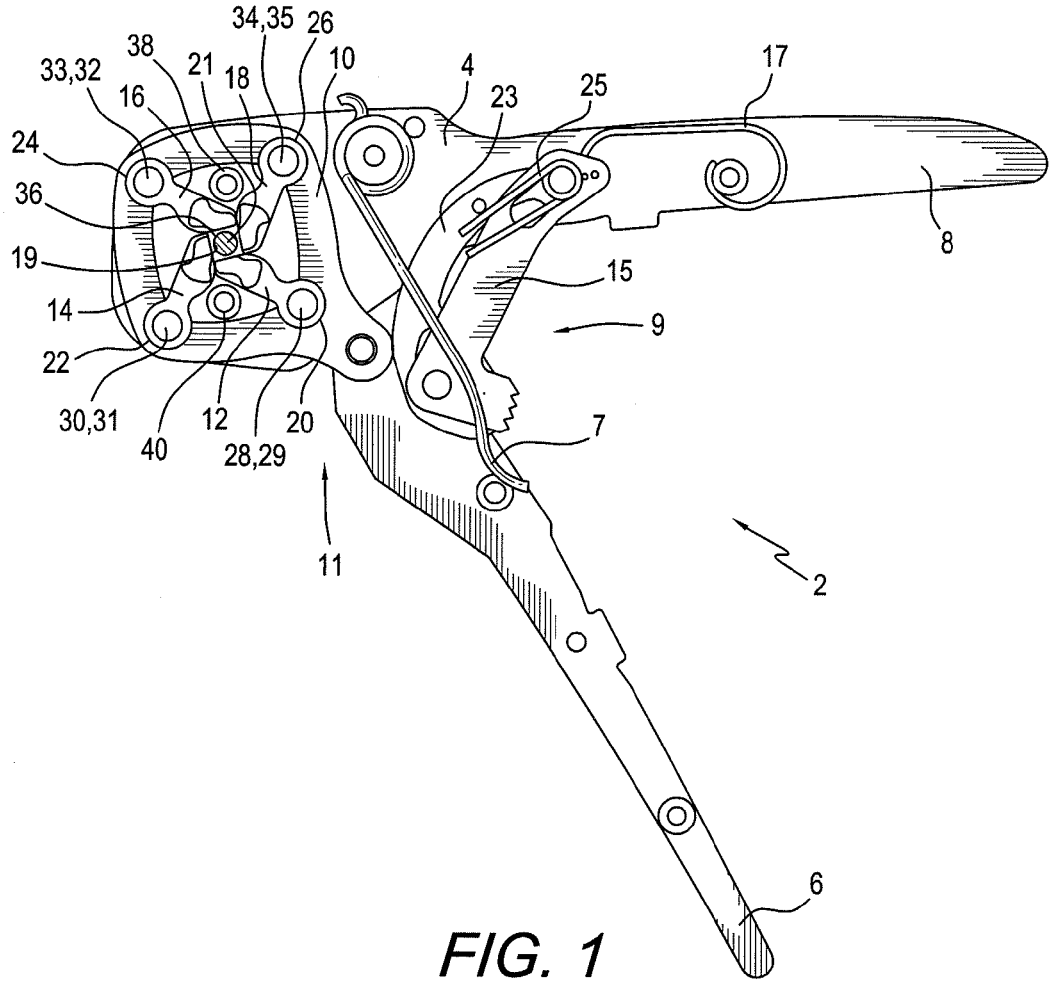
FIG. 1 shows schematically a side view of a crimping tool according to the invention in open position, i.e. before the beginning of the crimping stroke.

The same reference numerals are being used for similar features in the different drawings.

FIG. 1 shows schematically a side view of a crimping tool 2 according to the invention in an open position, i.e. before the beginning of the crimping stroke. The crimping tool 2 comprises a body 4, a first handle 6 and a second handle 8. The first handle 6 and the second handle 8 are movable relative to another, i.e. pivotally interconnected by a mechanism 9. The second handle 8 is integrated in the body 4 in this embodiment, but it may alternatively be movable relative to the body 4. The crimping tool further comprises a linkage 11 comprising a guide plate 10 and at least three crimping dies, in this embodiment four crimping dies 12,14,16,18, movable relative to one another, movable relative to the guide plate 10, and movable relative to the body 4, i.e. which are guided for displacement in the crimping tool 2. The crimping dies 12,14,16,18 are pivotally mounted and axially fixed, preferably near their respective ends 20,22,24,26, on the guide plate 10 using pins 28,30,32,34 arranged preferably perpendicular to the plane of the guide plate 10. This results in the pins 28,30,32,34 and thus the pivot points 29,31,33,35 of the crimping dies 12,14,16,18 being movable relative to the body 4 of the tool 2 as the guide plate 10 is arranged to be movable relative to the body 4 of the crimping tool 2. This will be further shown in FIG. 3. Further, a return spring 7 is shown which spring 7 presses apart the first handle 6 from the second handle 8. A toothed segment 15 is pressed by a second spring 17 away from the second handle 8 thus allowing a link 23 to be freely pressed by a third spring 25 against the end of the guide plate 10.

Figure 2:
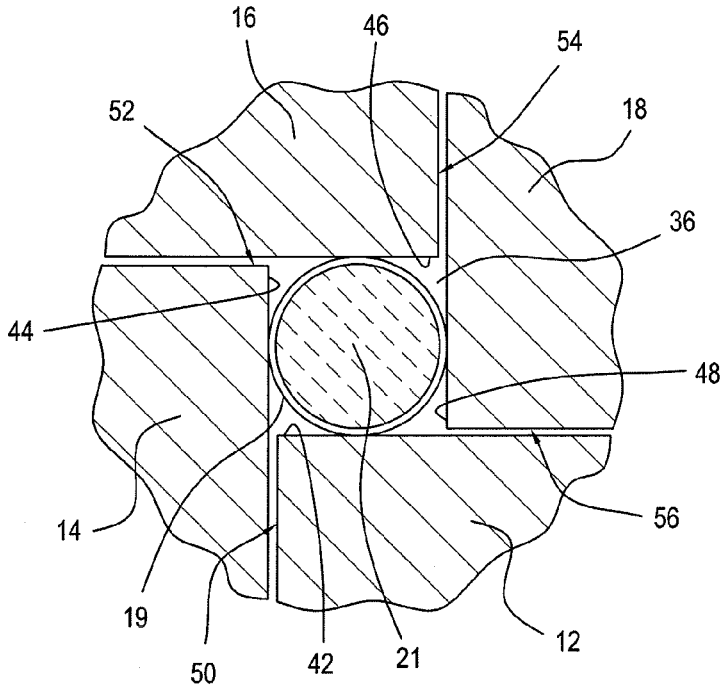
FIG. 2 shows the four crimping dies shown in FIG. 1 in an exploded view.

FIG. 2 shows the four crimping dies 12,14,16,18 shown in FIG. 1 in an exploded view. The four crimping dies 12,14,16,18 delimit an opening 36, in this embodiment a square opening, between them. By rotating the guide plate 10 clockwise, the movement of the guide plate 10 being enabled by at least two distance members 38,40 arranged on the body 4 of the crimping tool 2, the opening 36 will close as will be further shown in FIG. 3. A workpiece 19 to be crimped is inserted into the opening 36 delimited by the crimping dies 12,14,16,18 whereafter a cable 21, e.g. a stripped portion of a wire, is then inserted into the workpiece 19 to be crimped. This will be discussed more in detail below.

Figure 3:
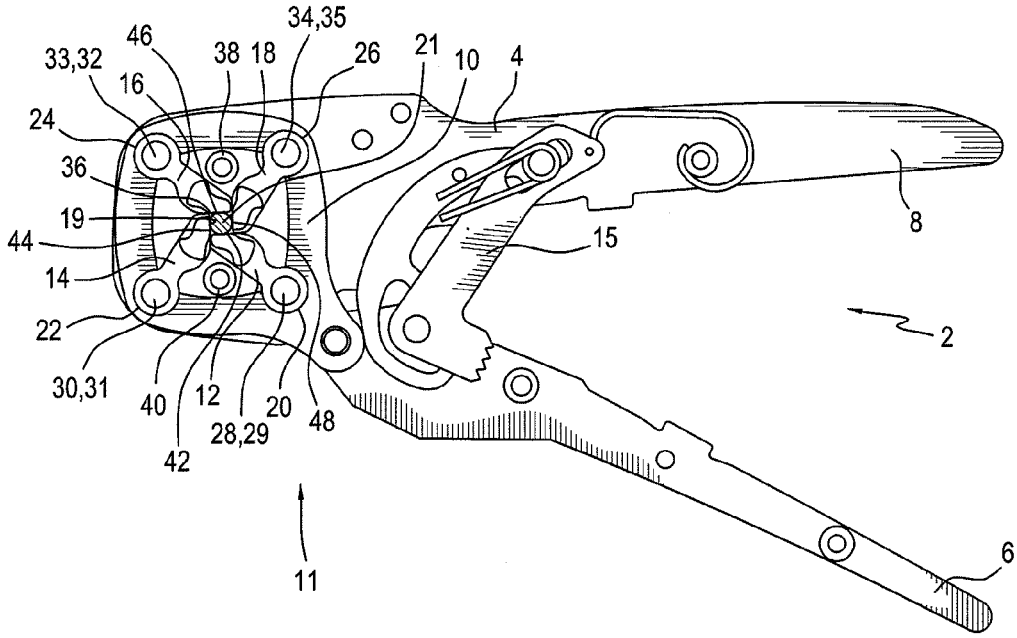
FIG. 3 shows schematically the crimping tool according to FIG. 1 in a closed position, i.e. after the crimping stroke.

FIG. 3 shows schematically the crimping tool according to FIG. 1 in a closed position, i.e. after the crimping stroke. The crimping tool 2 comprises, as mentioned above, a body 4, a first handle 6 and a second handle 8. The crimping tool further comprises a guide plate 10 and in this embodiment four crimping dies 12,14,16,18. A workpiece 19 to be crimped is inserted into the opening 36 delimited by the crimping dies 12,14,16,18. Thereafter, when the handles 6,8 are brought together, the guide plate 10 is rotated clockwise while the movement of the guide plate 10 being enabled by at least two distance members 38,40 arranged on the body 4 of the crimping tool 2. The movement of the guide plate 10 results in the movement of the pivot points 29,31,33,35 of the crimping dies 12,14,16,18 relative to the body 4 of the tool 2 and at the same time the closing of the opening 36 and crimping the workpiece 19. The closing of the opening 36 is performed in the following way by co-operating crimping dies 12,14,16,18. Now referring back to FIG. 2, each of the four crimping dies 12,14,16,18 have a respective crimping surface 42,44,46,48 and a respective sliding surface 50,52,54,56 each of which surfaces preferably are substantially straight, said respective crimping surface 42,44,46,48 and sliding surface 50,52,54,56 forming angles, preferably right angles when having four crimping dies 12,14,16,18, with one another. The sliding surface 50,52,54,56 of each crimping die 12,14,16,18 is in sliding contact with the adjacent crimping surface 42,44,46,48 of an adjacent crimping die 12,14,16,18. As will be further described below, when the guide plate 10 is rotated clockwise, the said sliding surfaces 50,52,54,56 slide against the said respective adjacent crimping surfaces 42,44,46,48 thus maintaining the shape, e.g. square shape, of the cross-section of the opening 36 delimited by the dies 12,14,16,18 as the opening 36 closes. The crimping dies 12,14,16,18 thus form a die profile of closed shape in all crimping positions. All crimping dies 12,14,16,18 thus actively take part in the crimping action. As can be seen in FIG. 3, the guide plate 10 and the pivot points 29,31,33,35 of the crimping dies 12,14,16,18 have moved relative to the body of the tool 2 when the handles 6,8 have been brought together to the closed position of the tool 2, i.e. when the first handle 6 is fully closed to the second handle 8, compared with the position of the guide plate 10 and the pivot points 29,31,33,35 of the crimping dies 12,14,16,18 as shown in FIG. 1 showing the open position of the tool 2. These movable pivot points produce a rolling movement between the pivot points 29,31,33,35 of the crimping dies 12,14,16,18 and the body 4 of the crimping tool 2, whereby the crimping surfaces 42,44,46,48 of the crimping dies 12,14,16,18 are made to act on the workpiece 19 to be crimped without the crimping dies 12,14,16,18 sliding on the surface of the body 4 of the tool 2 thereby decreasing the wear between the crimping dies 12,14,16,18 and the body 4 of the tool 2. If the pivot points would have been fixed relative to the body of the tool, this would have resulted in a sliding movement on the contact surface between the crimping dies and the body of the tool, and thus in more wear between them. It can be seen how the toothed segment 15 has moved during the crimping operation.

Figure 4:
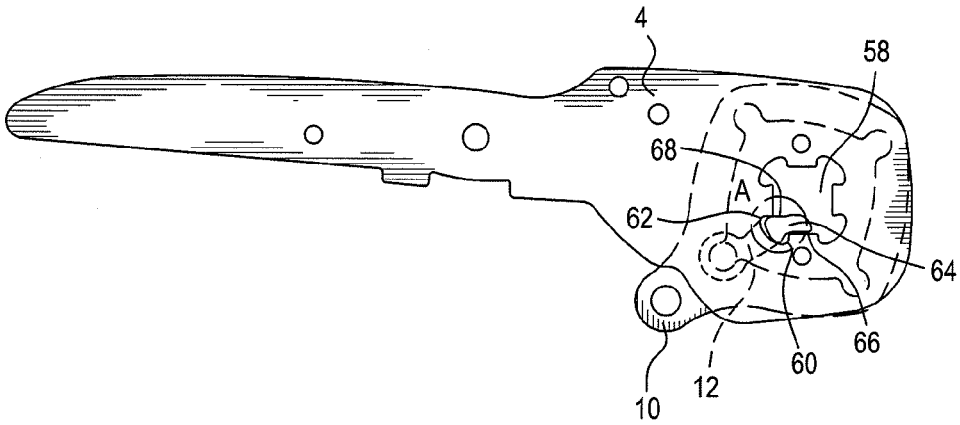
FIG. 4 shows schematically the body of the tool.

FIG. 4 shows schematically the body 4 of the tool, the body 4 having an opening 58 comprising tooth flanks 60,62 for a crimping die 12. Similar tooth flanks are arranged for all crimping dies 12,14,16,18. A crimping die 12 and the guide plate 10 are also shown. A shoulder 64 protruding from the crimping die 12 and formed with tooth flanks 66,68 can be seen arranged in the opening 58 in the body 4. The tooth flanks 66,68 on the shoulder 64 on the crimping die 12 cooperates with the tooth flanks 60,62 in the body 4 of the tool when the guide plate 10 is rotated clockwise or anti-clockwise thus keeping the sliding surface 50,52,54,56 of each crimping die 12,14,16,18 in sliding contact with the adjacent crimping surface 42,44,46,48 of an adjacent crimping die 12,14,16,18 (see FIG. 2).

Figure 5:
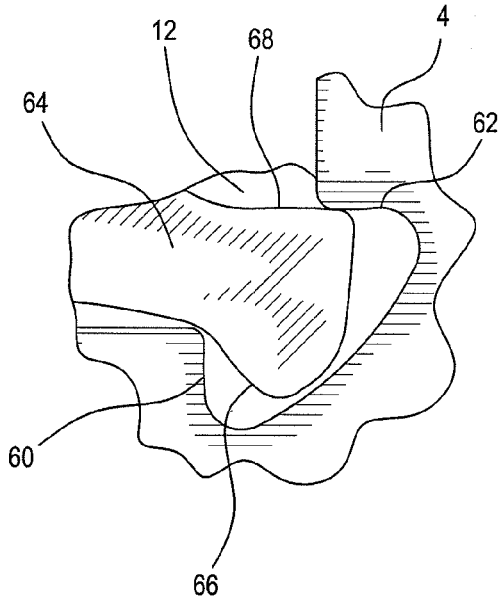
FIG. 5 shows schematically the cooperation between the tooth flanks on body and die.

FIG. 5 shows schematically the cooperation between the two tooth flanks 60,62 on the body 4 and the two tooth flanks 66,68 on the protruding shoulder 64 of the crimping die 12. When the guide plate 10 is rotated clockwise, the first tooth flanks 60,66 cooperate with a rolling movement without sliding relative to each other. When the guide plate 10 is rotated anti-clockwise, the second tooth flanks 62,68 cooperate in a similar manner. Thus, the crimping dies 12,14,16,18, i.e. their tooth flanks 66,68, do not slide on the surface, i.e. on the tooth flanks 60,62, of the body 4 of the tool 2 thereby decreasing the wear between the crimping dies 12,14,16,18 and the body of the tool 2.

When the guide plate 10 is rotated counterclockwise, the opening 36 is opened thus releasing the crimped workpiece 19 from the crimping tool 2.

As has been mentioned above, the crimping dies 12,14,16,18 are pivotally mounted and axially fixed, preferably near their respective ends 20,22,24,26, on the guide plate 10 using pins 28,30,32,34 arranged preferably perpendicular to the plane of the guide plate 10. Arranging the pins 28,30,32,34 through the respective ends 20,22,24,26 of the crimping dies 12,14,16,18, gives the advantage of a longer curve for the crimping surfaces 42,44,46,48 of the respective crimping dies 12,14,16,18, thus giving smaller clearance between the said sliding surfaces 50,52,54,56 and the said respective adjacent crimping surfaces 42,44,46,48.

Thus, the invention relates to a crimping tool 2 comprising at least three crimping dies 12,14,16,18 that are guided for displacement in the crimping tool 2, where each of the crimping dies 12,14,16,18 have a respective crimping surface 42,44,46,48 and a respective sliding surface 50,52,54,56, where the crimping surfaces 42,44,46,48 together form a crimping opening 36, said crimping surface 42,44,46,48 of each crimping die 12,14,16,18 slidably abutting said sliding surface 50,52,54,56, of an adjacent die, where the crimping dies 12,14,16,18 have pivot points 29,31,33,35 that are arranged movable relative to the body of the crimping tool 2 and where a linkage 11 is arranged to guide the movement of the pivot points 29,31,33,35 of the crimping dies 12,14,16,18 relative to the body 4 of the crimping tool 2, thus producing a rolling movement between the pivot points 29,31,33,35 of the crimping dies 12,14,16,18 and the body 4 of the crimping tool 2, whereby the crimping surfaces 42,44,46,48 of the crimping dies 12,14,16,18 are arranged to act on the workpiece 19 to be crimped without the crimping dies 12,14,16,18, i.e. their tooth flanks 66,68, sliding on the surface, i.e. on the tooth flanks 60,62, of the body 4 of the tool 2 thereby decreasing the wear between the crimping dies 12,14,16,18 and the body 4 of the tool 2.

FIG. 6-9 shows schematically the crimping tool according to FIG. 1 without the toothed segment 15 for better understanding of how the link 23 operates.

Figure 6:
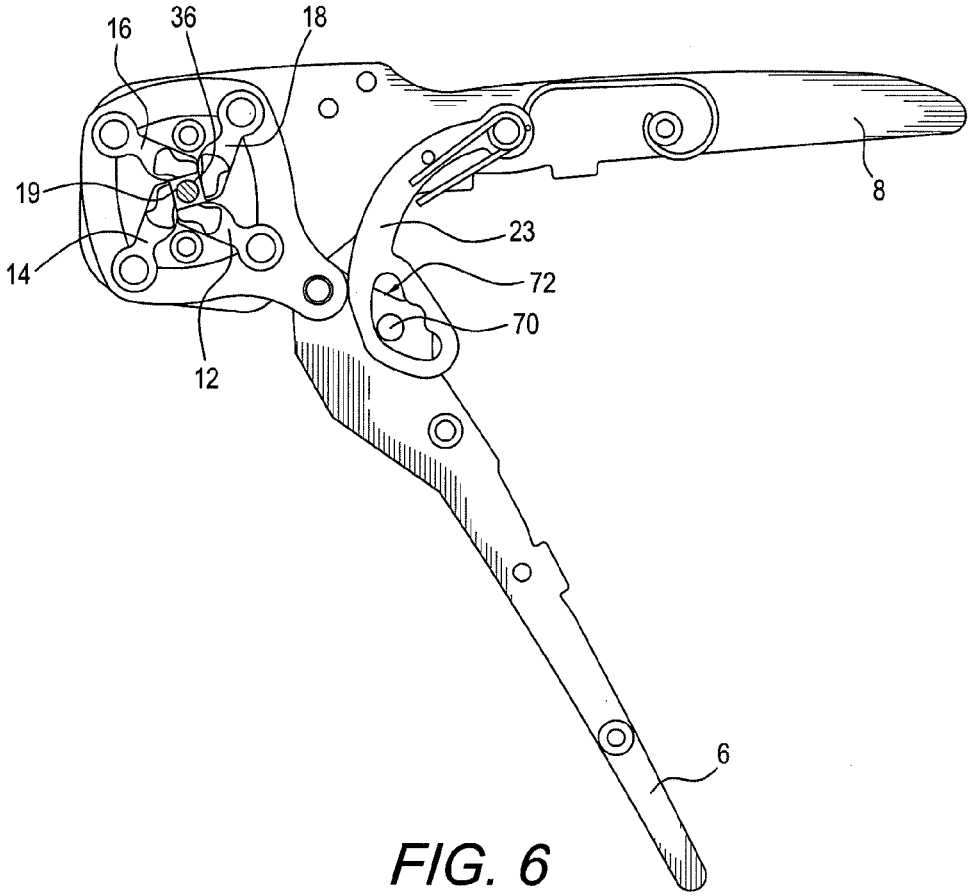
FIG. 6-9 shows the crimping tool according to FIG. 1 without the toothed segment.

The crimping tool 2 operates in the following manner:

FIG. 6 shows that the first handle 6 is provided with a guide element 70 and that the link 23 has an opening 72 wherein said guide element is engaged thus controlling the area of movement of the link 23 relative to the first handle 6. Firstly, a workpiece 19 to be crimped such as a connector or a similar device is inserted into the opening 36 delimited by the crimping dies 12,14,16,18.

Figure 7:
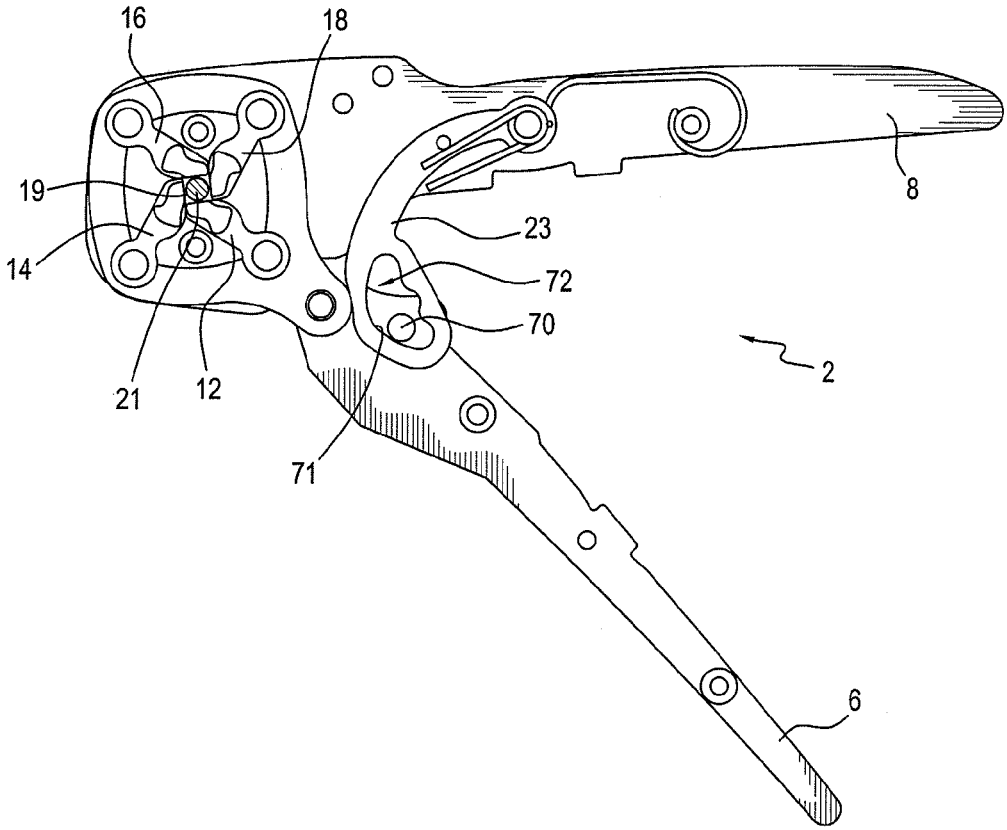

FIG. 7 shows that after insertion of the workpiece 19, the crimping tool 2 is operated by gently squeezing the handles 6,8 together making the crimping dies 12,14,16,18 move slightly against each other thereby coming into contact with and exerting pressure on the workpiece 19 to be crimped so that the workpiece 19 to be crimped is held in place without being deformed. This enables easy insertion of a cable 21, e.g. a stripped portion of a wire, into the workpiece 19 to be crimped. As can be seen, the guide element 70 arranged on the first handle 6 has moved relative to the link 23 along a first edge 71 of the opening 72.

Figure 8:
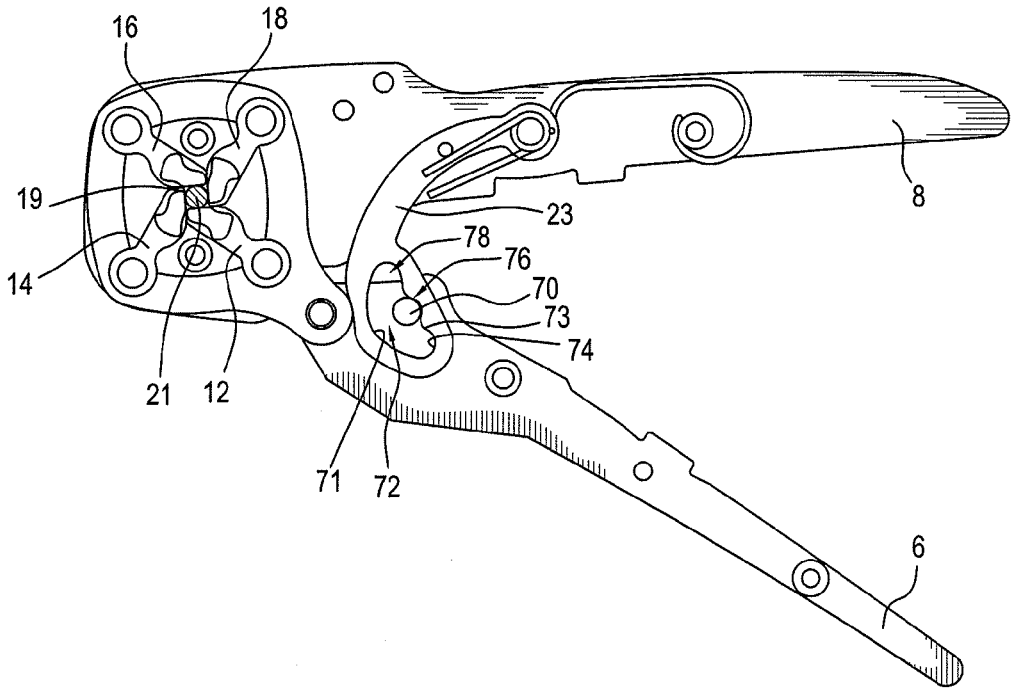

FIG. 8 shows that when the workpiece 19 and the cable 21 are aligned in a satisfactory way, the handles 6,8 are further squeezed together which makes the crimping dies 12,14,16,18 move against each other, and also makes the guide element 70 arranged on the first handle 6 to move into a recess 76, said recess 76 corresponding to a medium-range dimension of workpiece 19, on the other side of the opening 72 in the link 23. The guide element 70 is thus arranged to move from engagement with a first edge 71 of the opening 72 into engagement with a second opposite edge 73 of the opening 72 when the handles 6,8 are brought together to a position where the workpiece 19 is engaged by the crimping dies 12,14,16,18. As can be seen, in this embodiment three recesses 74,76,78 are arranged at the edge of the opening corresponding to three different ranges of workpiece 19 cross-section dimensions. The link 23 thus enables the person using the crimping tool 2 to utilize the optimum gripping range of the hand that is about to exert a large force on the handles 6,8 in order to bring them further together for the crimping of the workpiece 19, this regardless of the dimension of the workpiece 19 to be crimped. The optimum gripping range referred to above refers to the range of positions of the fingers of the hand where the hand and the fingers may exert the maximum force when the hand is clenched further together. This optimum gripping range is to be found in tables known in the art (see e.g. the article "Grip force Vectors for Varying Handle Diameters and Hand Sizes", HUMAN FACTORS, Vol, 46, No. 2, Summer 2004, pp 244-251, Human factors and Ergonomics Society).

Figure 9:
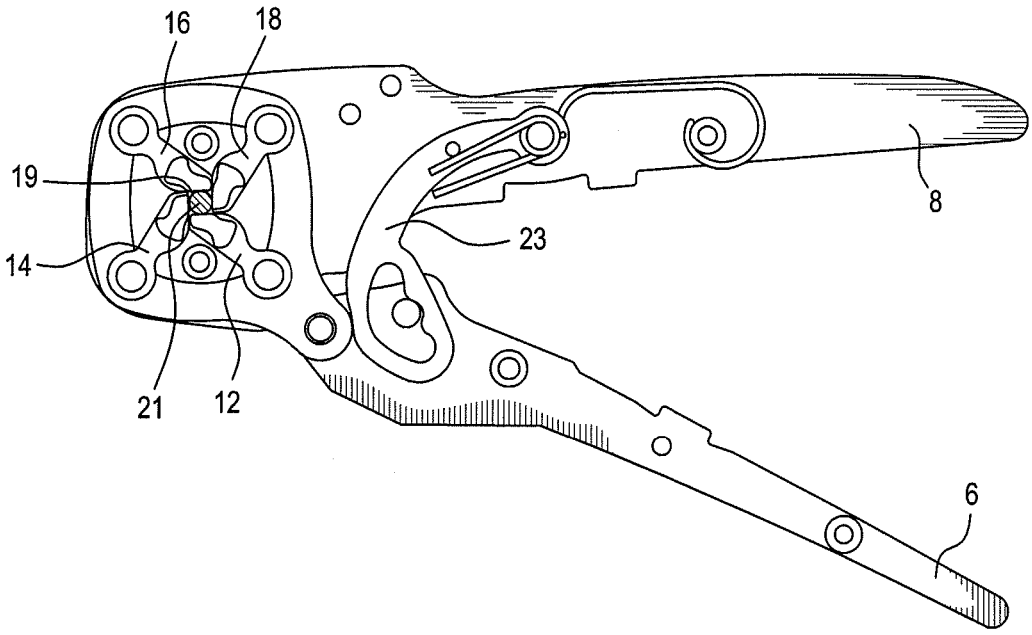

FIG. 9 shows that when the handles 6,8 are brought further together, this results in a crimped joint, in this embodiment with a square cross-section, with the workpiece 19 crimped about the cable 21. As can be seen, the link 23 is somewhat elastically deformed when the handles are brought further together, thus acting as a spring balancing the forces between the handles 6,8 and the crimping dies 12,14,16,18 in order to compensate for different dimension of the workpiece 19 which is within the ranges of workpiece 19 cross-section dimensions corresponding to the recess 74,76,78, recess 76 in this case.

Finally the handles 6,8 are released which in turn moves the crimping dies 12,14,16,18 apart thereby allowing removal of the crimped connector 19 from the crimping tool 2.

The invention claimed is:

1. A crimping tool comprising:

a body; and at least three crimping dies adjacent to another that are guided for displacement in the crimping tool, where each of the crimping dies comprises a respective crimping surface;

tooth flanks;

a respective sliding surface, where the crimping surfaces of each of the at least three crimping dies together form a crimping opening, the crimping surface of each crimping die slidably abutting said sliding surface of another adjacent one of the at least three crimping dies; and a pivot point that is arranged movable relative to the body of the crimping tool wherein a linkage is arranged to guide a movement of the pivot points of the crimping dies relative to the body of the crimping tool to produce a movement between the pivot points of the crimping dies and the body of the crimping tool, and wherein the tooth flanks of the crimping dies are arranged to cooperate with tooth flanks in the body of the crimping tool, whereby the crimping surfaces of the crimping dies are arranged to act on a workpiece to be crimped without the crimping dies sliding on the surface of the body of the tool thereby decreasing wear between the crimping dies and the body of the tool.

2. The crimping tool according to claim 1, wherein the crimping surfaces of the crimping dies are arranged to act on the workpiece to be crimped without the tooth flanks of the crimping dies sliding on the tooth flanks of the body of the tool thereby decreasing the wear between the crimping dies and the body of the tool.

3. The crimping tool according to claim 1, wherein said linkage comprises a guide plate for guiding the movement of the pivot points of the crimping dies, where the crimping dies are pivotally mounted and axially fixed to the guide plate, and where the guide plate is arranged movable relative to the body of the crimping tool.

4. The crimping tool according to claim 1, wherein said crimping surface and sliding surface of each crimping die form angles with one another, and where each of the crimping surfaces and sliding surfaces are substantially straight.

5. The crimping tool according to claim 3, wherein the crimping dies are pivotally mounted and axially fixed, near their respective ends, on the guide plate.

6. The crimping tool according to claim 1, further comprising a first handle and a second handle arranged to be movable in relation to one another.

7. The crimping tool according to claim 6, wherein the second handle is integrated in the body of the crimping tool.

8. The crimping tool according to claim 1, further comprising tool handles and a movable link arranged between the tool handles, the link having an opening arranged to engage a guide element on a first handle and being pivotally fixed to a second handle.

9. The crimping tool according to claim 8, wherein the movable link-comprises at least one recess at the edge of the opening and arranged for receiving the guide element said recess corresponding to the workpiece cross-section dimension range.

10. The crimping tool according to claim 8, wherein the movable link is arranged to be somewhat elastically deformable thus acting as a spring balancing the forces between the handles and the crimping dies when the guide element is in a recess at the edge of the opening and the handles are brought further together.

11. A crimping tool comprising:

a body;

a linkage;

body tooth flanks disposed in the body of the crimping tool; and at least three crimping dies arranged adjacent to each other, each die comprising:

a crimping surface, wherein the crimping surfaces of the at least three crimping dies are arranged to form a crimping opening;

a sliding surface;

die tooth flanks arranged to cooperate with the body tooth flanks to keep the sliding surface of one of the least three crimping dies in sliding contact with the crimping surface of another adjacent one of the at least three crimping dies; and a pivot point movably relative to the body of the crimping tool, wherein the linkage comprises a guide plate for guiding a movement of the pivot points of each of the at least three crimping dies where the crimping dies are pivotally mounted and axially fixed to the guide plate, and where the guide plate is arranged movable relative to the body of the crimping tool.

* * * * *